US006950375B2

(12) United States Patent
Duffner et al.

(10) Patent No.: US 6,950,375 B2
(45) Date of Patent: Sep. 27, 2005

(54) MULTI-PHASE CLOCK TIME STAMPING

(75) Inventors: Barbara J. Duffner, Fort Collins, CO (US); Larry S Metz, Ft Collins, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 448 days.

(21) Appl. No.: 10/320,914

(22) Filed: Dec. 17, 2002

(65) Prior Publication Data

US 2004/0114469 A1 Jun. 17, 2004

(51) Int. Cl.[7] ..... G04F 8/00; G04F 10/00; H03K 21/02; G06F 15/00

(52) U.S. Cl. ..... 368/113; 368/119; 368/121; 377/20; 702/79; 702/197

(58) Field of Search ..... 368/113, 118–121; 377/15, 20; 341/166; 702/79, 187

(56) References Cited

U.S. PATENT DOCUMENTS 4,731,768 A * 3/1988 Easterday ..... 368/118
5,166,959 A * 11/1992 Chu et al. ..... 377/20
5,333,162 A * 7/1994 Condreva ..... 377/20
5,703,838 A * 12/1997 Gorbics et al. ..... 368/120
5,793,709 A * 8/1998 Carley ..... 368/113
5,886,660 A * 3/1999 Loewenstein ..... 341/166
6,137,749 A * 10/2000 Sumner ..... 368/113
6,501,706 B1 * 12/2002 West ..... 368/118

OTHER PUBLICATIONS

Chakraborty, et al., "Practical Timing Analysis of Asynchronous Circuit Using Time Separation of Event," Computer System Laboratory, Stanford University, Stanford, CA 94305.

Chakraborty, et al., "Approximate Algorithms for Time Separation of Events," Computer Systems Laboratory, Stanford University, Stanford, CA 94305.

* cited by examiner

*Primary Examiner*—Vit W. Miska

(57) ABSTRACT

Multi-phase clock time stamping for improving time stamp resolution is provided. One of many possible embodiments is a method for generating a time stamp having an improved time resolution for an event signal. Briefly described, one such method comprises the steps of: receiving an event signal for which a time stamp is to be generated; generating a first pulse signal having a pulse width defined by the event signal and a first clock signal; generating a second pulse signal having a pulse width defined by the event signal and a second clock signal; and determining which of the first pulse signal and the second pulse signal is to be used for generating the time stamp for the event signal.

33 Claims, 12 Drawing Sheets

| $OUTPUT_3$ (918) | $OUTPUT_2$ (922) | $OUTPUT_1$ (920) | $OUTPUT_0$ (916) | PHASE (926) | PULSE_SEL (924) |
|---|---|---|---|---|---|
| 0 | 0 | 0 | 0 | 0 | 0 |
| 0 | 0 | 0 | 1 | 1 | 1 |
| 0 | 0 | 1 | 1 | 2 | 0 |
| 0 | 1 | 1 | 1 | 3 | 1 |
| 1 | 1 | 1 | 1 | 4 | 0 |
| 1 | 1 | 1 | 0 | 5 | 1 |
| 1 | 1 | 0 | 0 | 6 | 0 |
| 1 | 0 | 0 | 0 | 7 | 1 |

FIG. 12

MULTI-PHASE CLOCK TIME STAMPING

TECHNICAL FIELD

The present invention is generally related to systems, methods, and circuits for measuring the time difference between two asynchronous events and/or the time difference between a known reference signal and an event, and more particularly, to systems, methods, and circuits for generating a time stamp for an event signal.

BACKGROUND

Currently, there are a variety of applications in which it is desirable to determine the time of an event signal with respect to a reference signal. For instance, devices, such as time interval analyzers, time interval digitizers, timing discriminators, time interval counters, etc. (collectively referred to herein as "time interval analyzers") are typically used to measure the time difference between two asynchronous events. Such devices, as well as others, typically implement a time stamping circuit to determine the time of each particular event to be measured with respect to a reference signal. In this regard, the time stamping circuit may be viewed as generating a time stamp corresponding to each particular event to be measured. Thus, the time difference between the occurrence of two events may be measured by comparing the time stamp of one event to the time stamp of another.

There are a variety of existing time stamping techniques for determining the time of a particular event with respect to a reference signal. One common technique involves: (1) generating a pulse that begins with the event to be measured and ends with the reference signal; (2) converting the pulse to an analog voltage; and (3) measuring and converting the analog voltage into a digital value. FIG. 1 illustrates a schematic diagram of an existing system 102 that employs this technique. As illustrated in FIG. 1, system 102 includes a time stamping circuit 104, a ramp generator 110, an analog-digital converter (ADC) 112, and a digital signal processor (DSP) 114.

Typically, time stamping circuit 104 consists of a memory logic circuit 106 (e.g., a flip-flop, latch, other sequential logic circuit(s), etc.) having a data input for receiving an event signal (for which a time stamp is to be generated), an enable input for receiving a clock signal ($CLOCK_0$), and an output terminal for providing an output signal ($OUTPUT_0$). As known in the art, in sequential logic circuits, the output of the sequential circuit is a function of the current inputs and any signals that are fed back to the inputs. The so-called feedback signals may be referred to as the current state of the sequential logic circuit. Typically, a periodic external event (e.g., a clock) determines when the sequential logic circuit will change the current state to a new state. When the clocking event occurs, the sequential logic circuit samples the current inputs and the current state and determines a new, or next, state.

As further illustrated in FIG. 1, the output of memory logic circuit 106 and the original event signal are provided to a logic circuit, logic device, logic gate, etc. (e.g., "XOR" gate 108), which generates a pulse signal ($PULSE_0$). As stated above, the pulse signal ($PULSE_0$) begins with the event to be measured (i.e., the event signal) and ends with the reference signal (i.e., $CLOCK_0$). Referring again to FIG. 1, after the pulse signal ($PULSE_0$) is generated, it may be provided to ramp generator 110. As know in the art, ramp generator 110 converts the pulse signal ($PULSE_0$) into a corresponding voltage (Voltage ($PULSE_0$)). For example, ramp generator 110 may use the pulse signal ($PULSE_0$) to enable a current source that charges a capacitor for the duration of the pulse signal ($PULSE_0$), resulting in a voltage on the capacitor that is directly proportional to the length of the pulse signal ($PULSE_0$). Then, the voltage on the capacitor may be converted by ADC 112 and/or processed by DSP 114.

FIG. 2 is a timing diagram of the various relevant signals within time stamping circuit 104 that further illustrates its general operation. As illustrated in FIG. 2, the output signal ($OUTPUT_0$) of memory logic 106 is a function of the clock signal ($CLOCK_0$) and the event signal. For instance, where memory logic circuit 106 is implemented using a positive edge-triggered D flip-flop, each next state of the output signal ($OUTPUT_0$) is determined at the rising edge of the clock signal ($CLOCK_0$) based on the current state of the output signal ($OUTPUT_0$) and the current state of the event signal. Consider the situation in which an event to be time stamped occurs at time $t_E$. Referring to FIG. 1, the current state of the output signal ($OUTPUT_0$)—logic zero—will be changed to a next state—logic one—at the next rising edge of the clock signal ($CLOCK_0$) at time $t_C$. The pulse signal ($PULSE_0$) may be generated by performing a logical XOR operation based on the event signal and the output signal ($OUTPUT_0$). As illustrated in FIG. 2, the resulting pulse signal ($PULSE_0$) begins at time $t_E$ and ends at time $t_C$.

The time resolution provided by existing time stamping techniques, however, may be very limiting. In existing approaches, the resolution of the time stamp measurement is limited by the resolution of the ADC and, to a greater extent, the maximum frequency that the sequential logic (e.g., flip-flops) can be clocked. For example, because the time stamp measurement is directly proportional to the width of the pulse signal (i.e., $t_C-t_E$), the time resolution is limited by the period of the clock. In other words, the resolution of the time stamp measurement is defined by the maximum possible time between the occurrence of the event ($t_E$) and the next possible clock triggering event (i.e., positive clock edge or negative clock edge) at $t_C$. In such systems, the resolution may be calculated as the maximum pulse width divided by $2^n$ for an n-bit analog-to-digital converter. Using existing techniques, the resolution may be the clock period divided by $2^n$ for an ideal circuit.

Thus, there is a need in the industry for systems, methods, and circuits for improving the resolution of time stamping techniques.

SUMMARY

The present invention provides multi-phase clock time stamping. One of many possible embodiments is a method for generating a time stamp having an improved time resolution for an event signal. Briefly described, one such method comprises the steps of: receiving an event signal for which a time stamp is to be generated; generating a first pulse signal having a pulse width defined by the event signal and a first clock signal; generating a second pulse signal having a pulse width defined by the event signal and a second clock signal; and determining which of the first pulse signal and the second pulse signal is to be used for generating the time stamp for the event signal.

Another embodiment is a time stamping circuit for generating a time stamp having an improved time resolution for an event signal. Briefly described, one such time stamping circuit comprises: a first memory logic circuit comprising a first terminal for receiving a digital event signal, a second terminal for receiving a first clock signal, and a third terminal for providing a first digital output signal, a current state of the first digital output signal being changed to a next state based on the binary state of the digital event signal relative to the triggering edge of the first clock signal; a second memory logic circuit comprising a first terminal for receiving the digital event signal, a second terminal for receiving a second clock signal, and a third terminal for providing a second digital output signal, a current state of the first digital output signal being changed to a next state based on the binary state of the digital event signal relative to the triggering edge of the second clock signal; a first pulse generation circuit having a first input terminal for receiving the event signal, a second input terminal for receiving the first digital output signal, and an output terminal for providing a first pulse signal, the first pulse signal having a rising edge corresponding to the digital event signal and a falling edge corresponding to the first digital output signal; and a second pulse generation circuit having a first input terminal for receiving the event signal, a second input terminal for receiving the second digital output signal, and an output terminal for providing a second pulse signal, the second pulse signal having a rising edge corresponding to the digital event signal and a falling edge corresponding to the second digital output signal.

Briefly described, another such time stamping circuit comprises: a first memory logic circuit comprising a first terminal for receiving a digital event signal, a second terminal for receiving a first clock signal, and a third terminal for providing a first digital output signal, a current state of the first digital output signal being changed to a next state based on the binary state of the digital event signal relative to the positive edge of the first clock signal; a second memory logic circuit comprising a first terminal for receiving the digital event signal, a second terminal for receiving the first clock signal, and a third terminal for providing a second digital output signal, a current state of the second digital output signal being changed to a next state based on the binary state of the digital event signal relative to the negative edge of the first clock signal; a third memory logic circuit comprising a first terminal for receiving the digital event signal, a second terminal for receiving a second clock signal, and a third terminal for providing a third digital output signal, a current state of the third digital output signal being changed to a next state based on the binary state of the digital event signal relative to the positive edge of the second clock signal; and a fourth memory logic circuit comprising a first terminal for receiving the digital event signal, a second terminal for receiving the second clock signal, and a third terminal for providing a fourth digital output signal, a current state of the fourth digital output signal being changed to a next state based on the binary state of the digital event signal relative to the negative edge of the second clock signal.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 12 is a logic table illustrating the architecture, operation and/or functionality of an embodiment of the decoder of FIG. 9.

DETAILED DESCRIPTION

Figure 1:
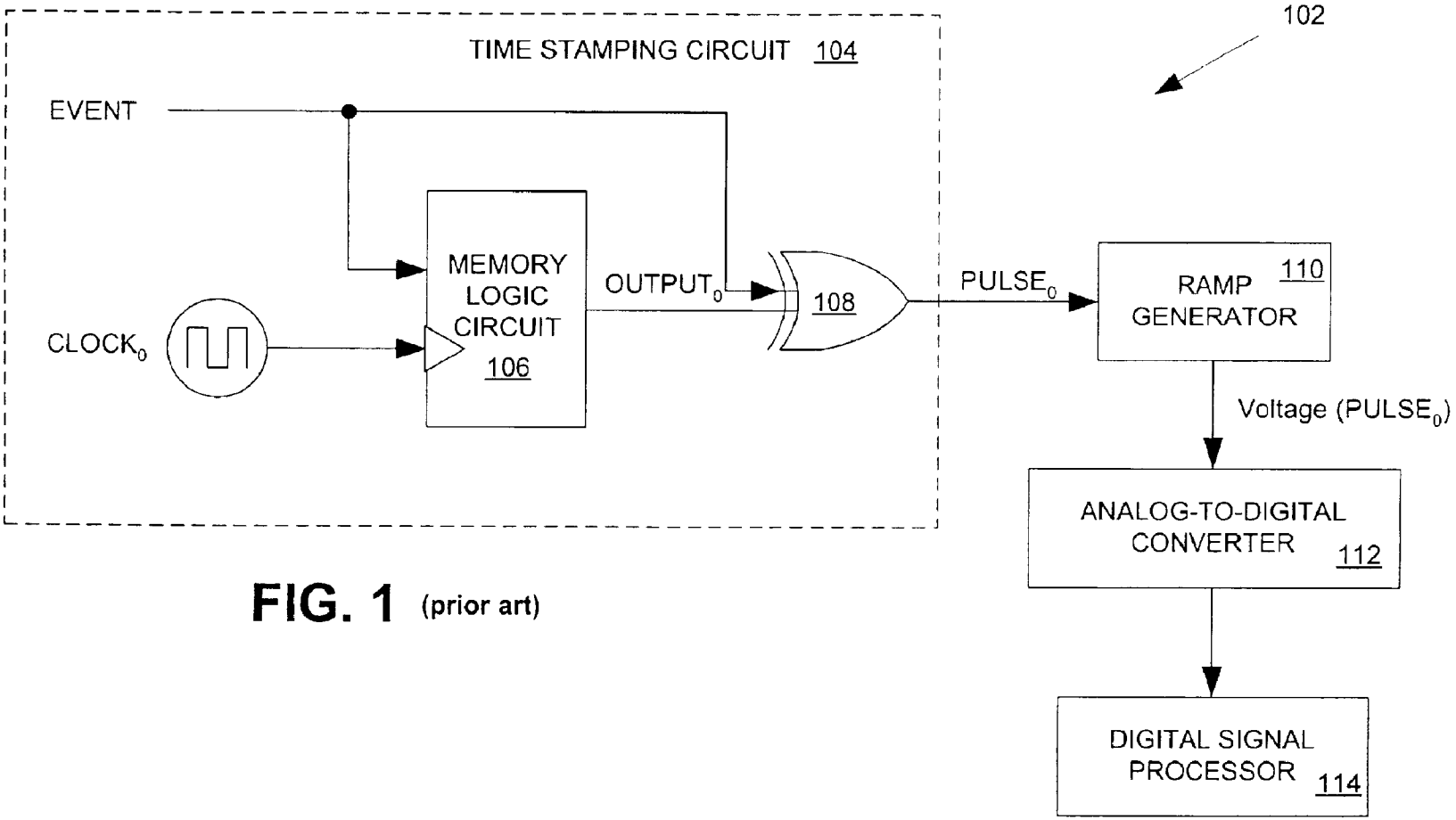
FIG. 1 (prior art)
FIG. 1 is a schematic diagram of an existing approach for time stamping, which includes an existing time stamping circuit.
Figure 2:
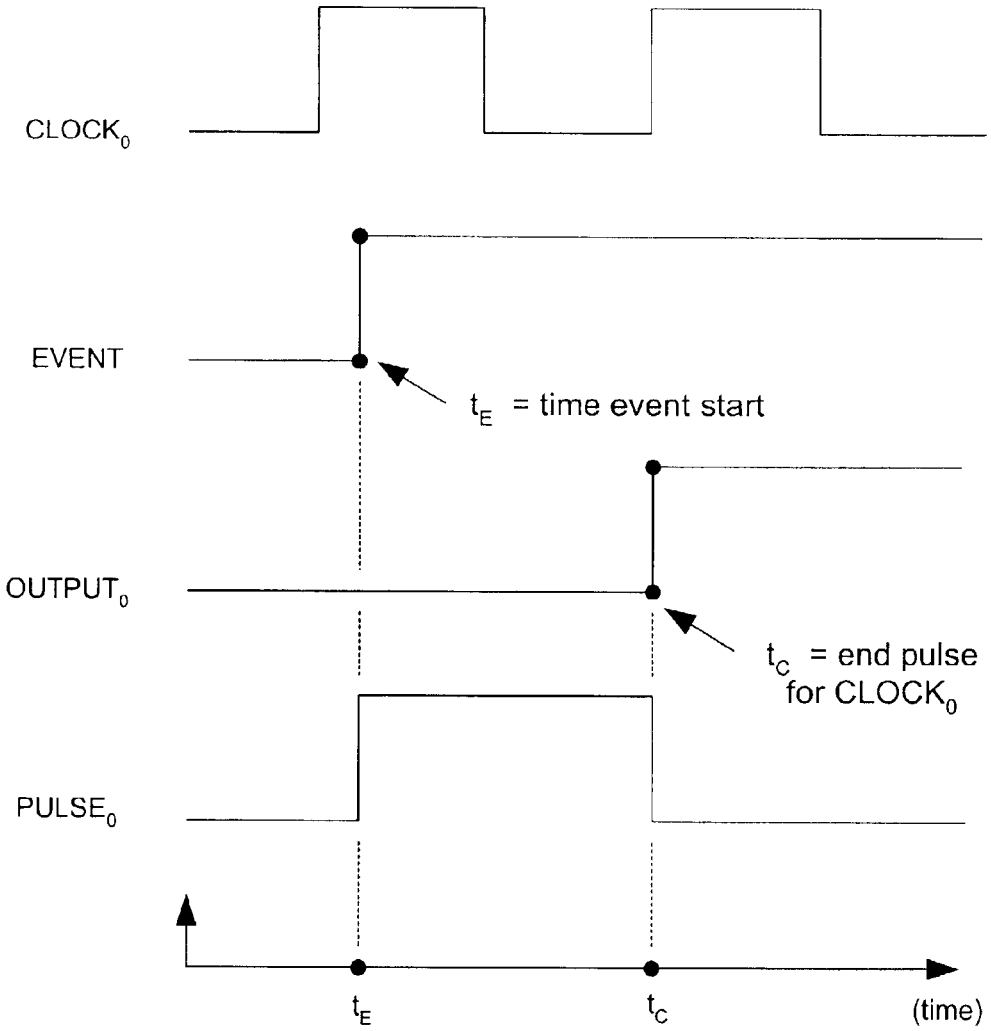
FIG. 2 (prior art)
FIG. 2 is a timing diagram of the relevant signals in the time stamping circuit of FIG. 1, which illustrates the operation of the time stamping circuit.
Figure 3:
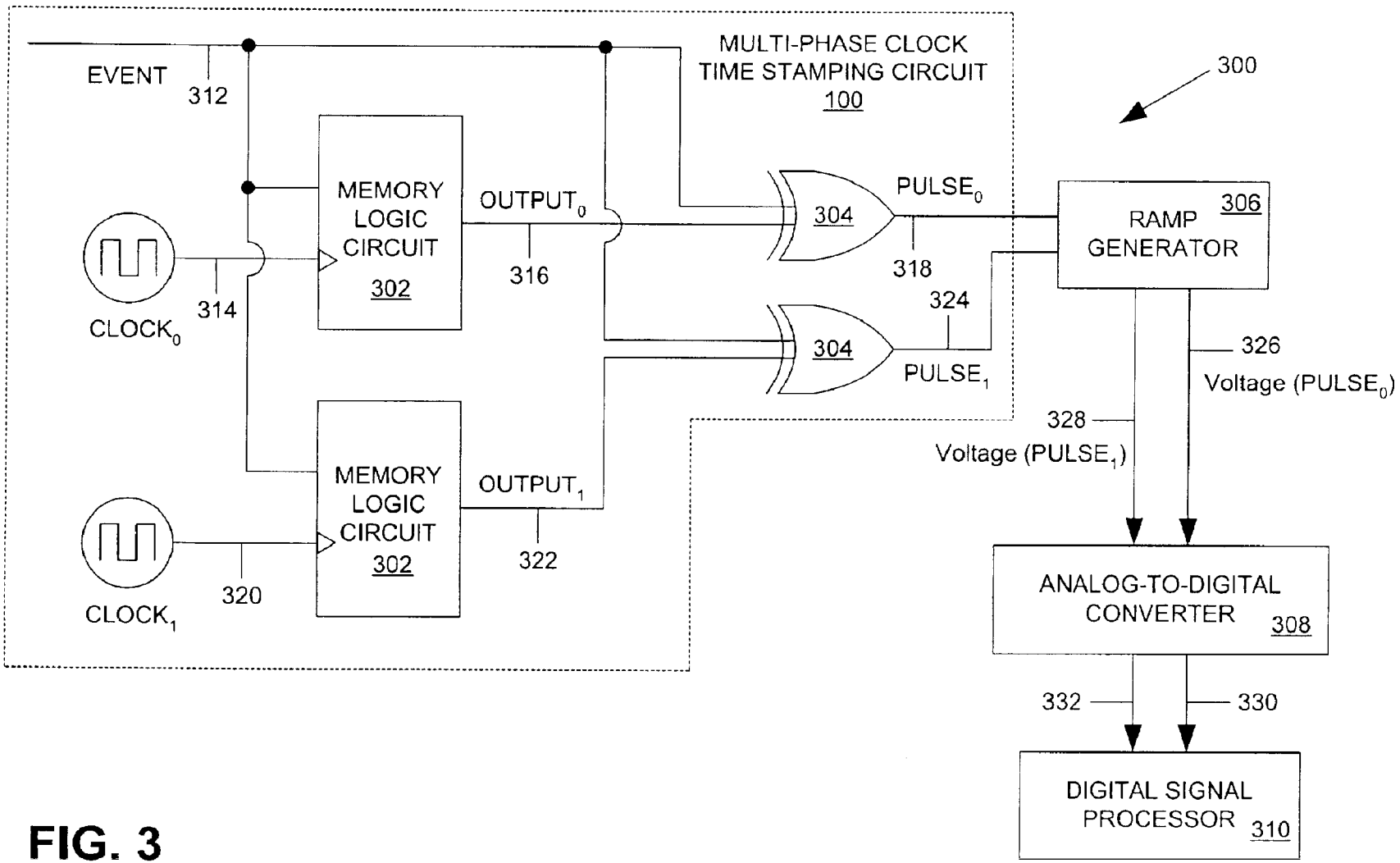
FIG. 3 is a schematic diagram of a system for providing time stamping, which includes one of a number of embodiments of a multi-phase clock time stamping circuit according to the present invention.

In general, the systems, methods, and circuits according to the present invention provide multi-phase clock time stamping. As described in more detail below, multi-phase clock time stamping enables time stamps to be generated during the time stamping process, which have improved resolution. FIG. 3 is a schematic diagram of an embodiment of a system 300 according to the present invention for determining the time of an event signal with respect to a reference signal (i.e., generate a time stamp for the event signal). As known in the art, there are a variety of applications in which it is desirable to determine the time of an event signal with respect to a reference signal. Therefore, system 300 may be implemented in devices, such as time interval analyzers, time interval digitizers, timing discriminators, time interval counters, etc. (collectively referred to herein as "time interval analyzers"). As known in the art, time interval analyzers are typically designed to measure the time difference between two asynchronous events by generating a time stamp for each asynchronous event and then comparing the respective time stamps.

Referring to FIG. 3, system 300 comprises one of a number of embodiments of a multi-phase clock time stamping circuit 100 according to the present invention, a ramp generator 306, an ADC 308, and a DSP 310. Multi-phase clock time stamping circuit 100 receives an event signal (for which a time stamp is to be generated) and at least two clock signals. Multi-phase clock time stamping circuit 100 generates at least two pulses, each of which is based on the event signal and a unique clock signal. For example, in the embodiment illustrated in FIG. 3, a first pulse signal ($PULSE_0$) may be generated based on the event signal and a first clock signal ($CLOCK_0$). In other words, the first pulse signal ($PULSE_0$) may have a rising edge corresponding to the event signal and a falling edge corresponding to the first clock signal ($CLOCK_0$). A second pulse signal ($PULSE_1$) may be generated based on the event signal and a second clock signal ($CLOCK_1$). The second pulse signal ($PULSE_1$) may have a rising edge corresponding to the event signal and a falling edge corresponding to the second clock signal ($CLOCK_1$). One of ordinary skill in the art will appreciate that the relationship between the first clock signal ($CLOCK_0$) and the second clock signal ($CLOCK_1$) may be defined such that the two clock signals divide the resulting clock period into two clock phases, $\phi$1 and $\phi$2.

Figure 4:
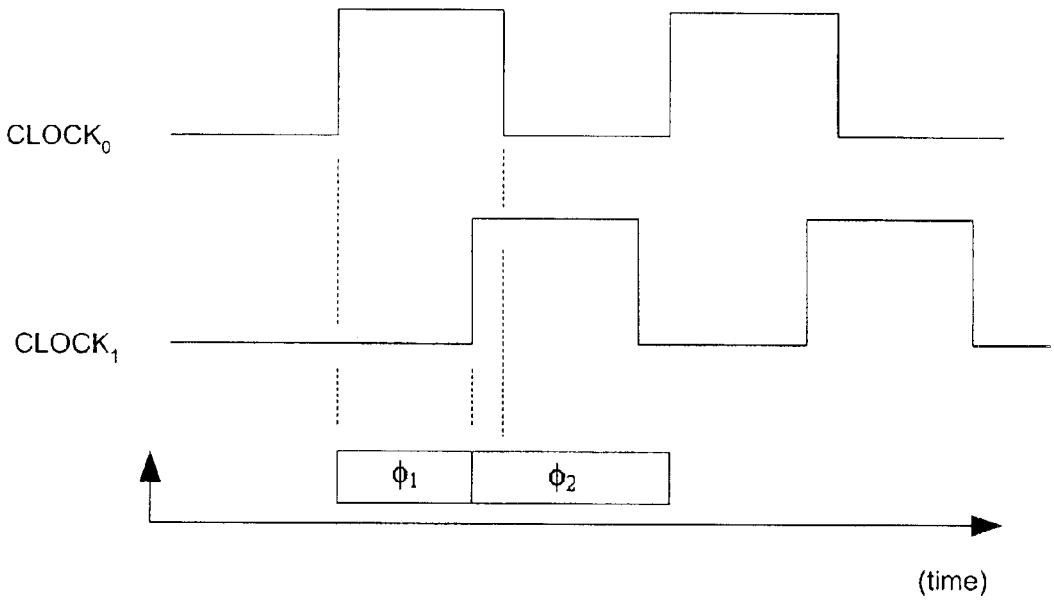
FIG. 4 is a timing diagram of two of the clock signals from the multi-phase clock time stamping circuit of FIG. 3.

FIG. 4 illustrates one of a number of possible configurations for the first clock signal ($CLOCK_0$) and the second clock signal ($CLOCK_1$). One of ordinary skill in the art will appreciate that various other configurations are contemplated by the present invention. For example, the second clock signal ($CLOCK_1$) may comprise the first clock signal ($CLOCK_0$) shifted by any predetermined amount of time. Furthermore, the first clock signal ($CLOCK_0$) and the second clock signal ($CLOCK_1$) may comprise 50% duty cycle clocks. In other words, the first clock phase, $\phi$1, may be defined by the rising edge of the first clock signal ($CLOCK_0$) and the rising edge of the second clock signal ($CLOCK_1$), while the second clock phase, $\phi$2, may be defined by the rising edge of the second clock signal ($CLOCK_1$) and the falling edge of the first clock signal ($CLOCK_0$). It should be appreciated that the clock signals may also be generated as described in U.S. Pat. Nos. 5,283,631, 5,243,227, and 5,214,680, each of which is hereby incorporated by reference in its entirety.

Referring again to FIG. 3, the first pulse signal ($PULSE_0$) and the second pulse signal ($PULSE_1$) may be provided to ramp generator 306. Although the embodiment illustrated in FIG. 3 shows both pulse signals being provided to ramp generator 306, in alternative embodiments, only one of the pulse signals may be provided to ramp generator 306. For instance, as described below in more detail, multi-phase clock time stamping circuit 100 may further comprise a pulse selection circuit, which is configured to determine which of the first pulse signal ($PULSE_0$) and the second pulse signal ($PULSE_1$) is to be used for generating the time stamp. In one of a number of possible embodiments, the pulse selection circuit may be configured to determine which of the pulse signals has the shorter pulse width (i.e., the amount of time between the occurrence of the event and the clock triggering event). The pulse signal having the shorter pulse width may be used to generate a time stamp having a higher time resolution. Thus, in certain embodiments, it may be advantageous to select one or more appropriate pulse signals to be provided to ramp generator 306, rather than providing all of the pulse signals. Furthermore, it should be appreciated that the pulse selection circuit may be provided between ramp generator 306 and ADC 308.

Regardless of the embodiment, the one or more pulse signals may be provided to ramp generator 306. As known in the art, ramp generator 306 converts the pulse signal(s) into a corresponding voltage. For example, ramp generator 306 may use the pulse signal to enable a current source that charges a capacitor for the duration of the pulse signal, resulting in a voltage on the capacitor that is directly proportional to the length of the pulse signal. Then, the voltage on the capacitor may be converted by ADC 308 and/or processed by DSP 310.

Having described the general operation of multi-phase clock time stamping circuit 100 and the general operation and components of system 300, the general architecture, operation, and/or functionality of the embodiment of multi-phase clock time stamping circuit 100 illustrated in FIG. 3 will be described. As illustrated in FIG. 3, multi-phase clock time stamping circuit 100 comprises at least two memory logic circuits 302 and corresponding pulse generation circuit(s) (e.g., logic circuit(s), logic device(s), logic gate(s), "XOR" gate(s) 108, circuit(s) with "XOR" functionality, etc.). A first memory logic circuit 302 may receive an event signal via connection 312 and a first clock signal ($CLOCK_0$) via connection 314. The first memory logic circuit 302 may be connected to a first pulse generation circuit via connection 316. In this regard, the first memory logic circuit 302 may provide a first digital output signal ($OUTPUT_0$). The first pulse generation circuit may receive the event signal via connection 312 and the first digital output signal ($OUTPUT_0$) via connection 316 and provide a first pulse signal ($PULSE_0$) to ramp generator 306 via connection 318. As will be described in more detail below, the first pulse signal ($PULSE_0$) may be defined by a rising edge corresponding to the event signal and a falling edge corresponding to the first digital output signal ($OUTPUT_0$).

A second memory logic circuit 302 may receive an event signal via connection 312 and a second clock signal ($CLOCK_1$) via connection 320. The second memory logic circuit 302 may be connected to a second pulse generation circuit via connection 322. In this regard, the second memory logic circuit 302 may provide a second digital output signal ($OUTPUT_1$). The second pulse generation circuit may receive the event signal via connection 312 and the second digital output signal ($OUTPUT_1$) via connection 322 and provide a second pulse signal ($PULSE_1$) to ramp generator 306 via connection 324. The second pulse signal ($PULSE_1$) may be defined by a rising edge corresponding to the event signal and a falling edge corresponding to the second digital output signal ($OUTPUT_1$).

One of ordinary skill in the art will appreciate that memory logic circuit 302 may comprise, for example, a flip-flop, latch, other sequential logic circuit(s), etc. In the embodiment illustrated in FIG. 3, memory logic circuit 302 comprises a data input for receiving the event signal (for which a time stamp is to be generated) via connection 312, an enable input for receiving the first clock signal ($CLOCK_0$) via connection 314, and an output terminal for providing the first digital output signal ($OUTPUT_0$) to connection 316. As known in the art, in sequential logic circuits, the output of the sequential circuit is a function of the current inputs and any signals that are fed back to the inputs. The so-called feedback signals may be referred to as the current state of the sequential logic circuit. Typically, a periodic external event (e.g., a clock) determines when the sequential logic circuit will change the current state to a new state. When the clocking event occurs, the sequential logic circuit samples the current inputs and the current state and determines a new, or next, state.

The pulse generation circuit(s) that receive the output signals of memory logic circuits 302 ($OUTPUT_0$ and $OUTPUT_1$) may comprise any type of logic circuit(s), logic device(s), logic gate(s), etc. In the embodiment illustrated in FIG. 3, the pulse generation circuits comprise an XOR gate 304 which performs the associated logic operation on the event signal and the corresponding output signal. In this manner, it will be appreciated that the pulse generation circuits generate a pulse signal having a rising edge corresponding to the event signal and a falling edge corresponding to the associated output signal.

Figure 5:
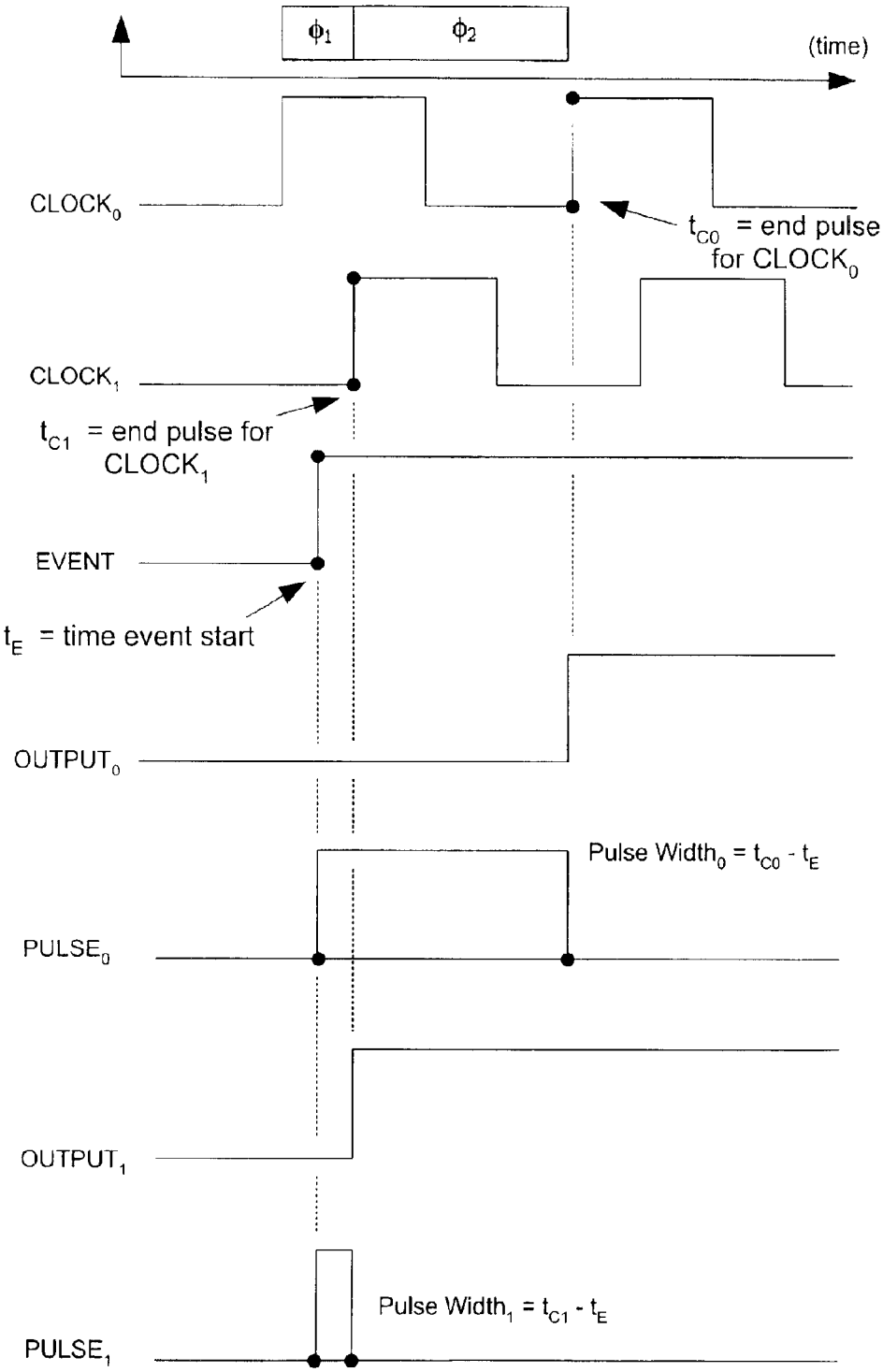
FIG. 5 is a series of timing diagrams of the relevant signals in the multi-phase clock time stamping circuit of FIG. 3.

The operation, architecture, and/or operation of multi-phase clock time stamping circuit 100 may be further clarified with reference to FIG. 5—a series of timing diagrams illustrating the relevant signals during operation of an embodiment of multi-phase clock time stamping circuit 100. Specifically, FIG. 5 illustrates the two clock phases, $\phi$1 and $\phi$2, defined by the two clock signals ($CLOCK_0$ and $CLOCK_1$), as well as the following signals: $CLOCK_0$, $CLOCK_1$, EVENT, $OUTPUT_0$, $PULSE_0$, $OUTPUT_1$, and $PULSE_1$. As stated above, the first memory logic circuit 302 may receive the event signal (EVENT) and the first clock signal ($CLOCK_0$). As illustrated in FIG. 5, it will be appreciated that the first digital output signal ($OUTPUT_0$) may become logic "one" at the next triggering edge of the first clock signal ($CLOCK_0$) after the event signal becomes a logic "one." In this regard, the event signal may occur at time=$t_E$ and the next triggering edge of the first clock signal may occur at time=$t_{C0}$. Thus, the first digital output signal ($OUTPUT_0$) may be enabled during the second clock phase, $\phi$2. Therefore, as known in the art, when the digital output signal ($OUTPUT_0$) and the event signal (EVENT) are processed by, for example, XOR gate 304, the resulting pulse signal ($PULSE_0$) may have a pulse width equal to ($t_{C0}-t_E$).

Similarly, the second memory logic circuit 302 may receive the event signal (EVENT) and the second clock signal ($CLOCK_1$). It will be appreciated that the output of the second memory logic circuit 302 ($OUTPUT_1$) may become logic "one" at the next triggering edge of the second clock signal ($CLOCK_1$) after the event signal becomes a logic "one." In this regard, the event signal may occur at time=$t_E$ and the next triggering edge of the second clock signal may occur at time=$t_{C1}$. Thus, the second digital output signal ($OUTPUT_1$) may be enabled during the first clock phase, $\phi$1. Thus, as known in the art, when the digital output signal ($OUTPUT_1$) and the event signal (EVENT) are processed by, for example, XOR gate 304, the resulting pulse signal ($PULSE_1$) may have a pulse width equal to ($t_{C1}-t_E$).

As described in more detail below in alternative embodiments, multi-phase clock time stamping circuit 100 may further comprise a pulse selection circuit for determining which of the first pulse signal ($PULSE_0$) and the second pulse signal ($PULSE_1$) is to be used for generating the time stamp for the event signal (e.g., which pulse has a shorter pulse width, etc.). One of ordinary skill in the art will appreciate that a shorter pulse width may be used to produce a time stamp having an improved resolution due to the shorter amount of time between the event (time=$t_E$) and the clock trigger. Although the complexity of multi-phase clock time stamping circuit 100 may increase by including the pulse selection circuit, the overall process may be improved by reducing the number of pulse signals that need to be converted and/or processed via ramp generator 306, ADC 308, and DSP 310. However, it will be appreciated that, in alternative embodiments, the means for selecting the appropriate pulse to be used for generating the time stamp may be implemented in circuitry external to multi-phase clock time stamping circuit 100. For example, in one alternative embodiment, each of the pulse signals may be provided to ramp generator 306 to be converted, while the selection of the appropriate time stamp may be performed within DSP 310.

Memory logic gate 302 may be implemented using a variety of other sequential logic circuit(s). For example, one of ordinary skill in the art will appreciate that multi-phase clock time stamping circuit 100 may be implemented using flip-flops, latches, other sequential logic circuit(s), etc. The important aspect is that multi-phase clock time stamping circuit 100 employs at least two clock signals, which may be used to generate multiple pulse signals. Because multiple pulse signals may be generated, the pulse signal having the shortest pulse width may be selected to generate the time stamp for the event. In this manner, a time stamp having improved resolution may be generated. It will be further appreciated that multi-phase clock time stamping circuit 100 may comprise additional clock signals, additional memory logic circuits 302, pulse generation circuit(s), etc. in order to generate more clock phases and further improve the resolution of the resulting time stamps.

Figure 6:
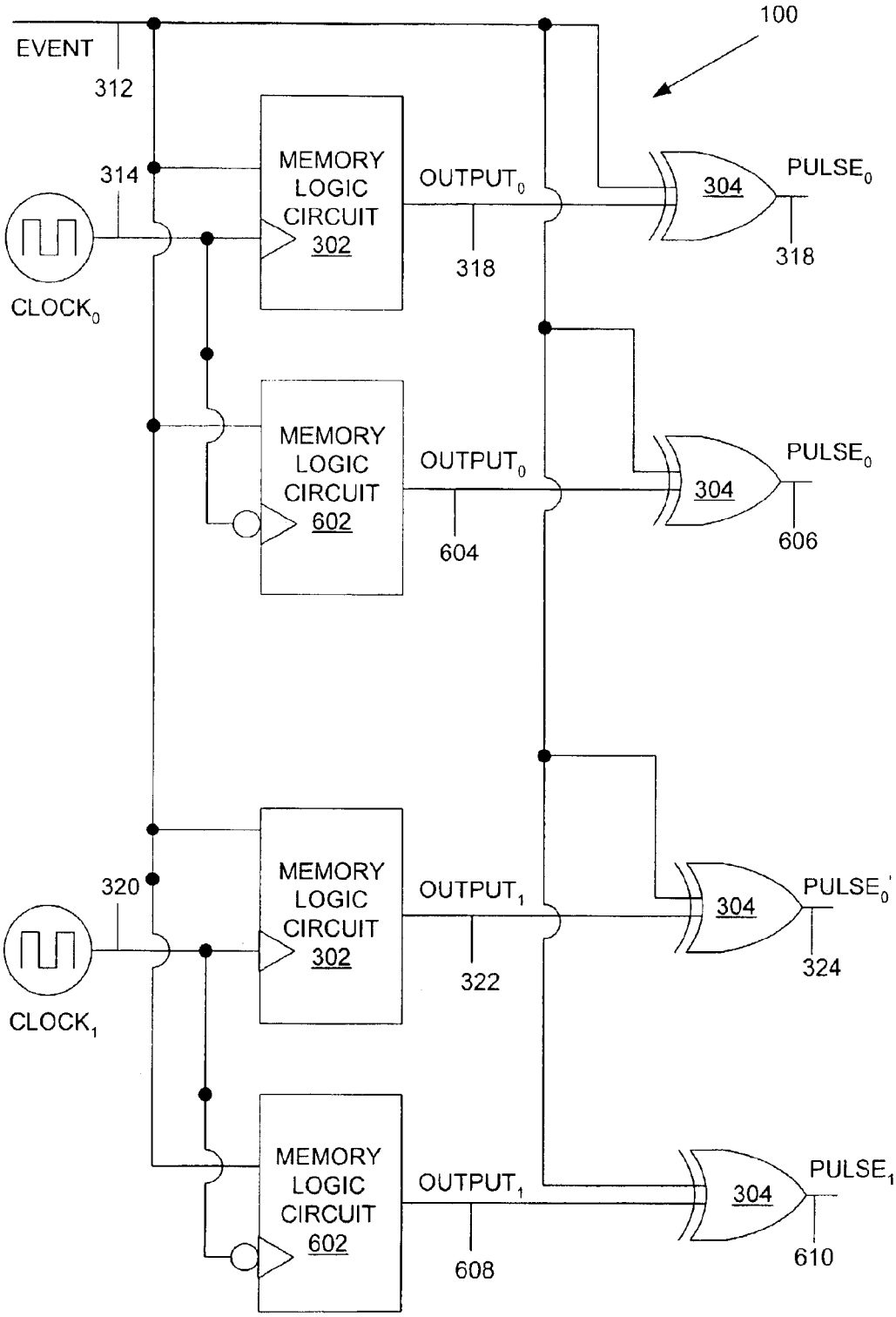
FIG. 6 is a schematic diagram of another embodiment of a multi-phase clock time stamping circuit according to the present invention.

In this regard, FIG. 6 illustrates an alternative embodiment of multi-phase clock time stamping circuit 100. In this embodiment, multi-phase clock time stamping circuit 100 is configured as described above, except for the addition of a second memory logic circuit 602 (and corresponding pulse selection circuit) for each clock signal. For example, the event signal and each clock signal may be provided to two memory logic circuits 302 and 602. In this embodiment, for each clock signal, a first memory logic circuit 302 may be configured as a positive edge-triggered device, while a second memory logic circuit 602 may be configured as a negative edge-triggered device. In this manner, each clock signal may be used to generate two digital outputs: For example, $CLOCK_0$ may be used to generate (1) a first OUTPUT ($OUTPUT_0$) corresponding to the positive edge-triggered device (connection 318) and (2) a second OUTPUT ($OUTPUT_0'$) corresponding to the negative edge-triggered device (connection 604). As described above, each output signal may be processed by a pulse generation circuit (e.g., XOR gate 304) to generate two separate pulse signals ($PULSE_0$ and $PULSE_0'$). Referring again to the timing diagrams of FIG. 5, it will be appreciated that the first pulse signal for $CLOCK_0$($PULSE_0$) may have a rising edge corresponding to the event signal and a falling edge corresponding to the next rising edge of the clock signal after the event signal. The second pulse signal for $CLOCK_0$ ($PULSE_0$) may have a rising edge corresponding to the event signal and a falling edge corresponding to the next falling edge of the clock signal after the event signal. Similarly, as illustrated in FIG. 6, $CLOCK_1$ may be used to generate two pulse signals ($PULSE_1$ and $PULSE_1'$). In this manner, multi-phase clock time stamping circuit 100 may be used to generate a time stamp having improved resolution.

Figure 7:
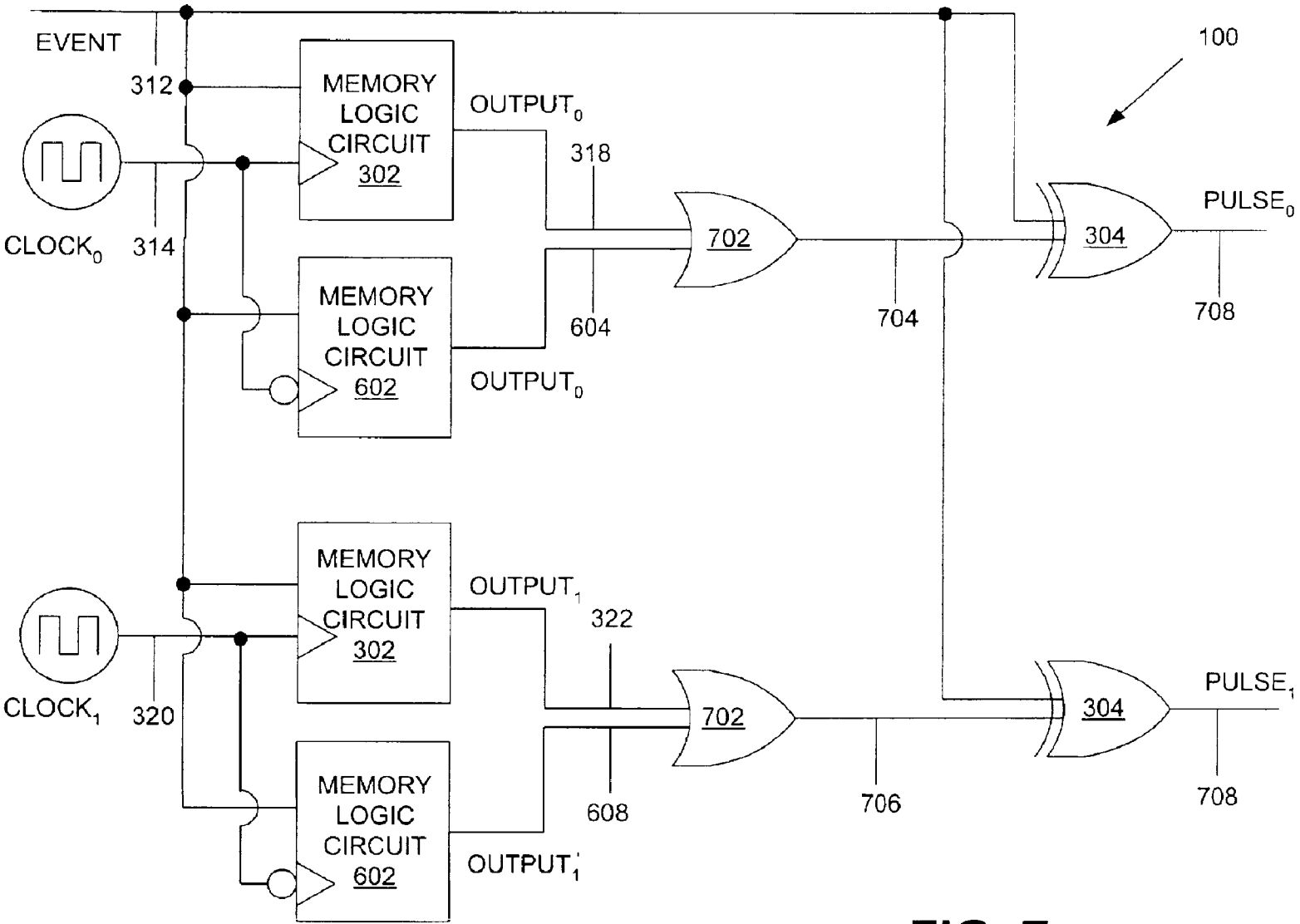
FIG. 7 is a schematic diagram of a further embodiment of a multi-phase clock time stamping circuit according to the present invention.

It was mentioned above that multi-phase clock time stamping circuit 100 may further comprise pulse selection circuitry for determining which signals to be used to generate the stamp for the event signal. FIG. 7 is a schematic diagram of a further embodiment of multi-phase clock time stamping circuit 100, which employs pulse selection circuitry (e.g., OR gates 702) to minimize the number of pulses that are required to be generated. In general, an OR gate 702 is used to "select" one of the two output signals produced by each memory logic circuit pair 302/602 to generate a pulse signal is generated. As known in the art, where the two inputs to an OR gate 702 comprise two step functions (i.e., $OUTPUT_0$, $OUTPUT_0'$, $OUPUT_1$, $OUTPUT_1'$, etc.), the output of the OR gate 702 will comprise the step function that begins at the earliest time due to logic or operation In other words, OR gate 702 will "select" the output signal that detected the event signal at the earliest point in time.

The embodiment of multi-phase clock time stamping circuit 100 illustrated in FIG. 7 is similar to that illustrated in FIG. 6. Specifically, each clock signal is provided to two memory logic circuits 302 and 602: one a negative edge-triggered device and the other a positive edge-triggered device. In the embodiment of FIG. 7, the digital output signals for each memory logic circuit 302 and 602 are not provided to a unique pulse generation circuit (e.g., XOR gate 304). Rather, as illustrated in FIG. 7, each pair of digital output signals generated by a corresponding memory logic circuit 302/602 are provided to a pulse selection circuit (e.g., logic circuit(s), logic device(s), "OR" gate 702, etc.). As described above, one of ordinary skill in the art will appreciate that the pulse selection circuit may be configured to determine which of the digital output signals (e.g., $OUPUT_0$ (connection or $OUTPUT_0'$ (connection 604)) will produce a pulse signal having a shorter pulse width. In the simplest case, performing the logic "OR" operation on the pair of digital output signals and then performing a logic "XOR" on the resulting signal and the event signal will result in the pulse signal having the shorter pulse width. However, one of ordinary skill in the art will appreciate that the pulse selection circuitry may be implemented in a number of alternative configurations using alternative and/or additional logic circuit(s), logic device(s), logic gate(s), etc.

Figure 8:
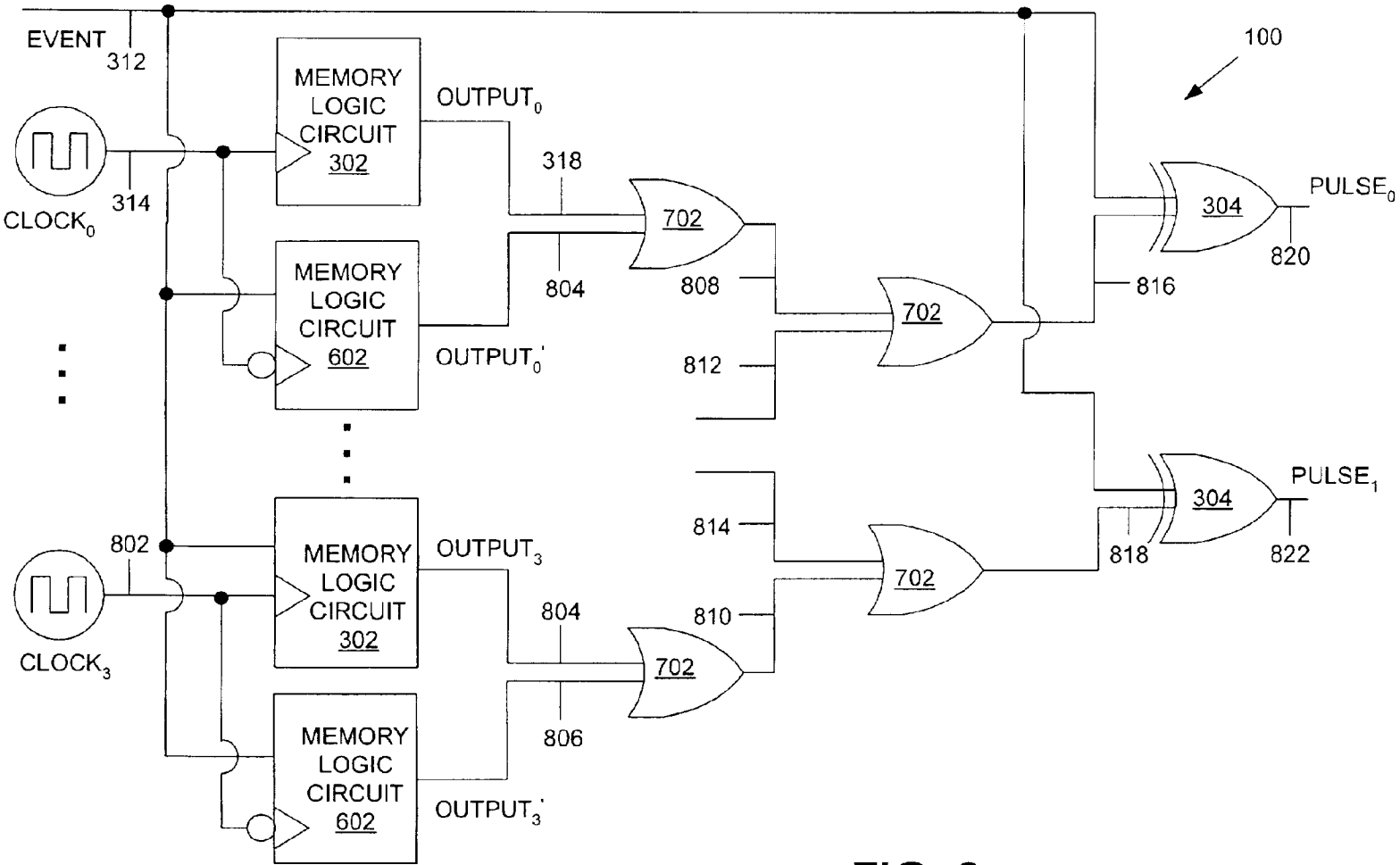
FIG. 8 is a schematic diagram of a further embodiment of a multi-phase clock time stamping circuit according to the present invention.

Although the embodiment of multi-phase clock time stamping circuit 100 illustrated in FIG. 7 uses only two clock signals, it will be appreciated that alternative pulse selection circuitry may be implemented where more than two clock signals are used. FIG. 8 illustrates an alternative embodiment of multi-phase clock time stamping circuit 100. As illustrated in FIG. 8, multi-phase clock time stamping circuit 100 may include four clock signals and four pairs of memory logic circuits 302/602 (one positive edge-triggered and the other negative edge-triggered). In this configuration, it will be appreciated that the pulse selection circuitry may comprise two stages of "OR" gates 702, in which even and odd signals are logically "OR'ed." The first stage comprises four "OR" gates 702, each of which performs the associated logic operation on the pair of digital signal outputs provided by the pair of memory logic circuits 302/602.

As was the case in the embodiment illustrated in FIG. 7, the first stage may comprise four OR gates 702 that receive the digital signal outputs from each memory logic circuit pair 302/602. In this manner, each OR gate 702 "selects" one of the digital output signals provided by each memory logic circuit pair 302/602, which "detected" the event signal at an earlier point in time. Therefore, the digital output signal that would produce a higher resolution time stamp is passed on to the second stage.

The second stage may comprise two OR gates 702. For example, referring to FIG. 8, a first OR gate 702 in the second stage may be connected to the output of the OR gate 702 from the first stage corresponding to the first clock signal ($CLOCK_0$) and the output of the OR gate 702 from the first stage corresponding to the third clock signal ($CLOCK_3$). A second OR gate 702 in the second stage may be connected to the output of the OR gate 702 from the first stage corresponding to the second clock signal ($CLOCK_2$) and the output of the OR gate 702 from the first stage corresponding to the fourth clock signal ($CLOCK_4$). In other words, the second stage further selects one of the two digital output signals selected in the first stage. In this manner, the original eight digital outputs signals provided by the memory logic circuit pairs 302/602 for each clock signal may be reduced to the two signals that will produce the highest resolution time stamp.

One of ordinary skill in the art will appreciate that the embodiment of multi-phase clock time stamping circuit 100 illustrated in FIG. 8 may be modified to include any number of clock signals. It will be further appreciated that the pulse selection circuitry may be easily configured to account for this modification. For example, depending on the number of clock signals employed, additional stages of OR gates 702 may be used to determine the two signals that will produce the highest resolution time stamp.

Figure 10:
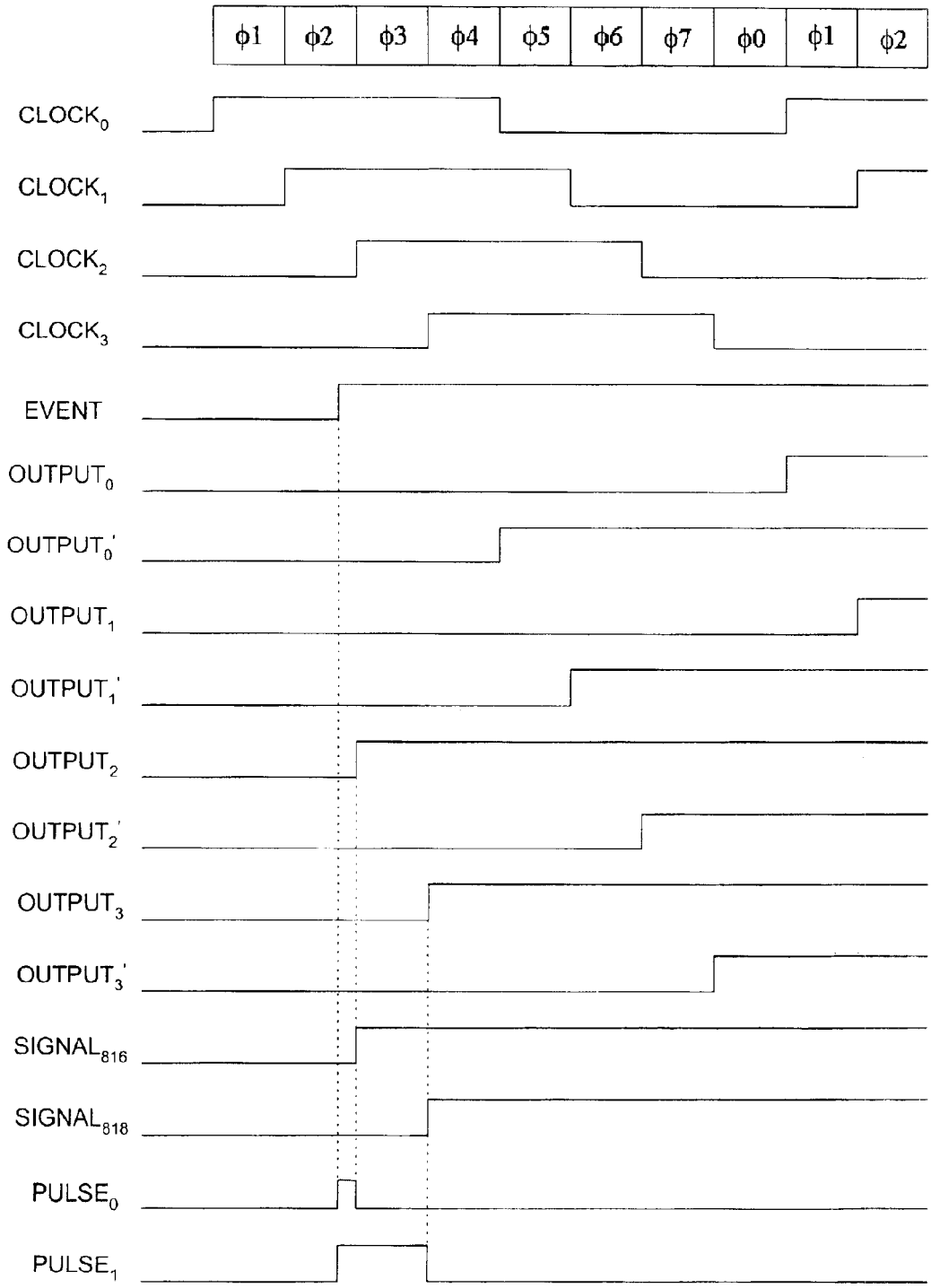
FIG. 10 is a series of timing diagrams of the relevant signals in the multi-phase clock time stamping circuit of FIG. 8.

Referring again to FIG. 8, the two outputs of the pulse selection circuitry may be provided to respective pulse generation circuits (e.g., XOR gates 304). As described above, the generated pulses (e.g., $PULSE_0$ and $PULSE_1$) may be provided to a ramp generator 306, ADC 308, DSP 310, etc. for further processing. The operation of multi-phase clock time stamping circuit 100 illustrated in FIG. 8 is further clarified with reference to the timing diagrams of FIG. 10.

Figure 9:
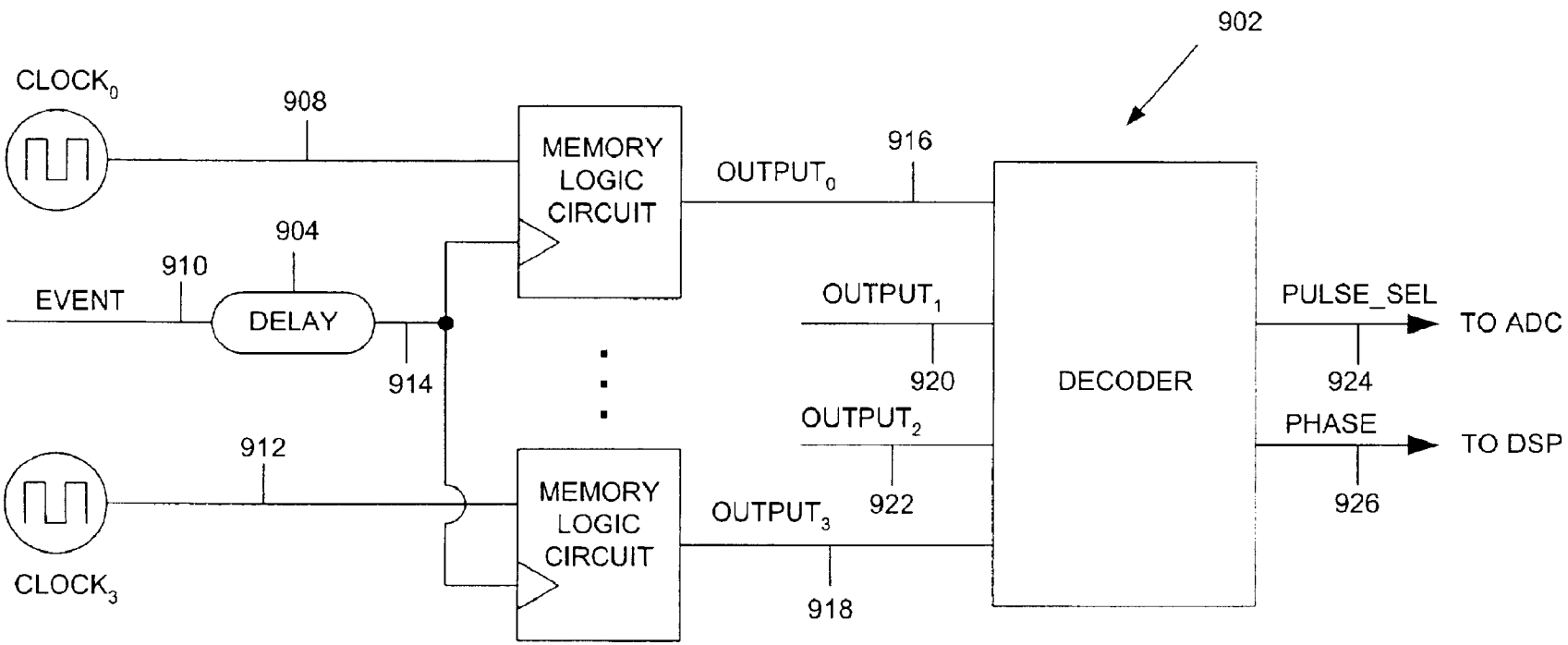
FIG. 9 is a schematic diagram of an embodiment of a pulse selection circuit according to the present invention, which may be incorporated in the multi-phase clock time stamping circuits of FIGS. 3 and 6–8, for selecting which of the generated pulse signal(s) are to be used for generating the time stamp for the event signal.

It will be appreciated, with reference to FIG. 9, that the embodiment of multiphase clock time stamping circuit 100 illustrated in FIG. 8 may further comprise additional pulse selection circuitry for determining which pulse signal is to be used for generating a time stamp for the event signal. In one of a number of embodiments, the additional pulse selection circuitry may be configured to determine which of the pulse signals should be used to generate the time stamp for the event. For example, as described above with respect to FIG. 8, the first and second stages may reduce the number of pulses to be generated to two by performing a logical OR operation on successive pairs of outputs from the memory logic circuit pairs 302/602, the outputs of OR gates 702, etc. Therefore, additional pulse selection circuitry may be implemented to determine which of the two remaining pulses are to be used to generate the time stamp for the event.

FIG. 9 is a schematic diagram of an embodiment of a pulse selection circuit 902 according to the present invention, which may be incorporated in multi-phase clock time stamping circuit 100 to determine which generated pulse signal to be used for generating the time stamp for the event (i.e., which pulse signal will generate the higher resolution time stamp). In the embodiment illustrated in FIG. 9, pulse selection circuit 902 comprises four memory logic circuits 302, a delay element 904, and a decoder 906. Each of the four memory logic circuits 302 correspond to one of the clock signals ($CLOCK_0$, $CLOCK_1$, $CLOCK_2$, $CLOCK_3$, $CLOCK_4$). Thus, it will be appreciated that more or less memory logic circuits 302 may be employed, depending on the particular configuration of multi-phase time stamping circuit 100.

Figure 11:
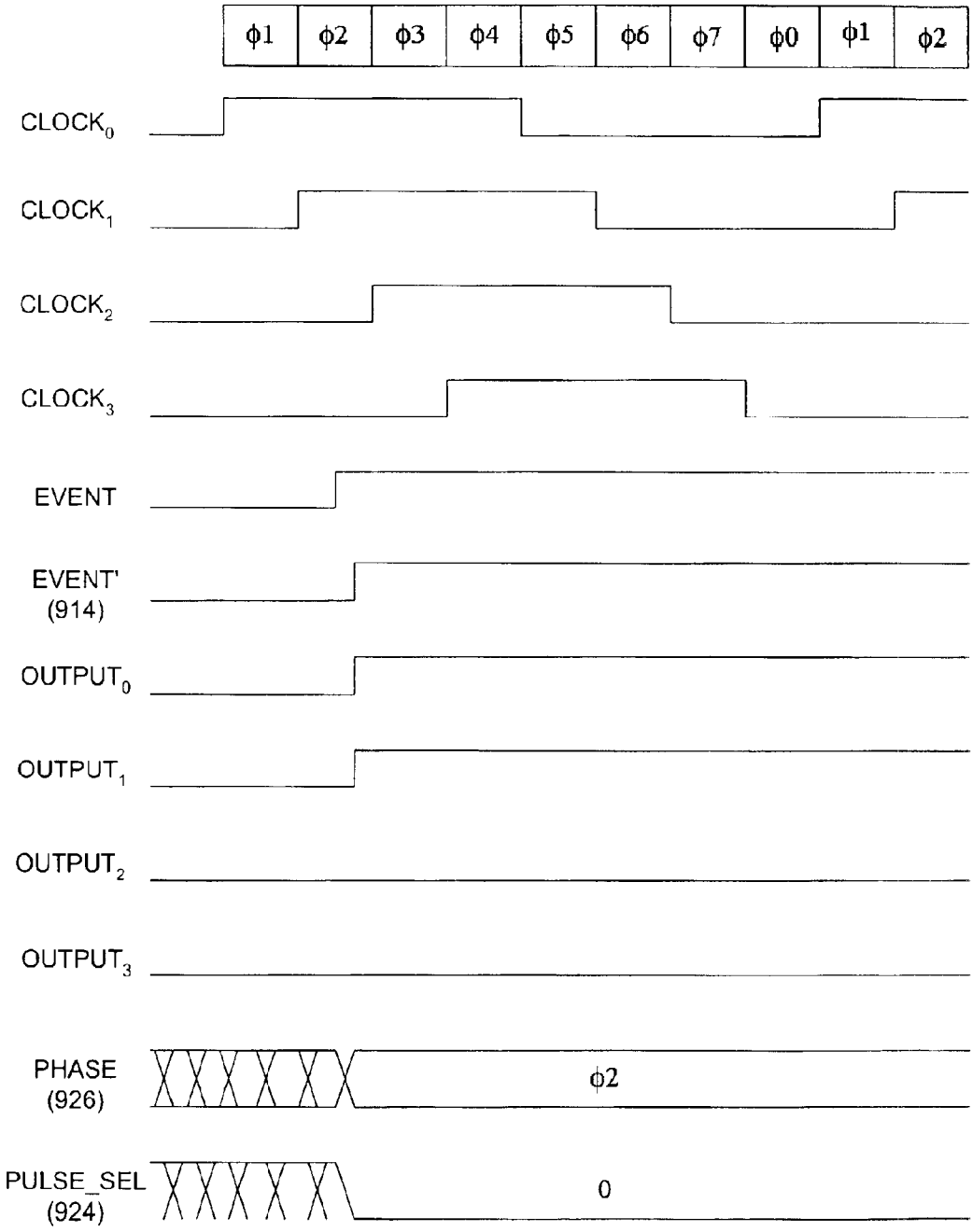
FIG. 11 is a series of timing diagrams of the relevant signals in the pulse selection circuit of FIG. 9.

As stated above, the relationship between the clock signals may be defined such that the clock signals divide the resulting clock period into a series of clock phases, $\phi 1$, $\phi 2$, . . . $\phi N$. For example, FIG. 4 illustrates a two phase clock defined by two clock signals. The embodiment of FIG. 9 illustrates an eight phase clock, based on the four clock signals each acting as a positive edge trigger and a negative edge trigger. FIG. 11 is a series of timing diagrams of relevant signals in pulse selection circuit 902.

In general, pulse selection circuit 902 determines the clock phase in which the event occurs. Based on this information, pulse selection circuit 902 may generate and provide suitably configured signal(s), which may be used to identify and/or select the appropriate pulse to be used to generate the time stamp. For instance, the decoder may be configured based on the logic table illustrated in FIG. 12. In this manner, the decoder may provide the appropriate clock phase on connection 926 to DSP 310 and a pulse selection command on connection 924 to ADC 308. Thus, in the embodiment illustrated in FIG. 11, the decoder may provide a digital value "2" on connection 926 to DSP 310, indicating that the event occurred in clock $\phi$2. Furthermore, the decoder may provide a logic zero signal on connection 924 to ADC 308, indicating that $PULSE_0$ should be used to generate the time stamp for the event signal.

One of ordinary skill in the art will appreciate that memory logic circuit(s) 302 may comprise, for example, a flip-flop, latch, other sequential logic circuit(s), etc. In the embodiment illustrated in FIG. 9, memory logic circuits 302 comprise a data input for receiving the appropriate clock signal ($CLOCK_0$, $CLOCK_1$, $CLOCK_2$, $CLOCK_3$, $CLOCK_4$), an enable input for receiving the event signal, and an output signal for providing a digital output signal to decoder 906. As known in the art, in sequential logic circuits, the output of the sequential circuit is a function of the current inputs and any signals that are fed back to the inputs. The so-called feedback signals may be referred to as the current state of the sequential logic circuit. Typically, a periodic external event (e.g., a clock) determines when the sequential logic circuit will change the current state to a new state. When the clocking event occurs (i.e., the event signal received via connection 910), the sequential logic circuit samples the current inputs (the clock signal) and the current state and determines a new, or next, state.

As illustrated in FIG. 9, the event signal may be received by a delay element 904 via connection 910. As known in the art, delay element 904 may receive the event signal, inject a predetermined amount of time delay (if desirable), and provide the delayed event signal to memory logic circuit 302 via connection 914.

In this manner, pulse selection circuit 902 may capture the state of each clock signal at the time of the event signal. This is used for two purposes. For N phases and capture phase Y, the time of the event with respect to the original clock (CLOCK0) is Y*period/N minus the time determined from the selected pulse width. The phase may also be decoded and used to determine which of the two pulses should be used to generate the time stamp for the event signal. Each pulse may be as long as two phases, and it may be desirable not to select either a minimum or a maximum pulse because these are generated when the event occurs very close to a particular clock edge. The delay supplied by delay element 904 may be adjusted so that the phase transitions occur in the "sweet spot" of the pulse. Because the same signal is used for both phase determination and pulse selection, there will be no ambiguity in the measurement.

As stated above, system 300 and multi-phase clock time stamping circuit 100 may be implemented in devices, such as time interval analyzers, time interval digitizers, timing discriminators, time interval counters, etc. (collectively referred to herein as "time interval analyzers"). As known in the art, timing interval analyzers are typically designed to measure the time difference between two asynchronous events by generating a time stamp for each asynchronous event and then comparing the respective time stamps.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A method for generating a time stamp having an improved time resolution for an event signal, the method comprising the steps of:

receiving an event signal for which a time stamp is to be generated;

generating a first pulse signal having a pulse width defined by the event signal and a first clock signal;

generating a second pulse signal having a pulse width defined by the event signal and a second clock signal; and determining which of the first pulse signal and the second pulse signal is to be used for generating the time stamp for the event signal.

2. The method of claim 1, wherein the second clock signal comprises the first clock signal shifted by a predetermined amount of time.

3. The method of claim 1, wherein the first clock signal and the second clock signal have 50% duty cycle.

4. The method of claim 1, wherein the step of determining which of the first and second pulse signals is to be used comprises selecting the pulse signal having the shorter pulse width.

5. The method of claim 1, further comprising the step of defining a time stamp for the event signal.

6. The method of claim 5, wherein the step of defining a time stamp involves the step of determining a numerical value corresponding to the pulse signal having the shorter pulse width.

7. The method of claim 1, further comprising the step of converting the pulse signal to be used for generating the time stamp.

8. The method of claim 6, wherein the step of converting the pulse signal to a numerical value further comprises the steps of:

converting the pulse signal to be used for generating the time stamp to an analog voltage; and converting the analog voltage to a digital value.

9. A time stamping circuit for generating a time stamp having an improved time resolution for an event signal, the time stamping circuit comprising:

a first memory logic circuit comprising a first terminal for receiving a digital event signal, a second terminal for receiving a first clock signal, and a third terminal for providing a first digital output signal, a current state of the first digital output signal being changed to a next state based on the binary state of the digital event signal relative to the triggering edge of the first clock signal;

a second memory logic circuit comprising a first terminal for receiving the digital event signal, a second terminal for receiving a second clock signal, and a third terminal for providing a second digital output signal, a current state of the first digital output signal being changed to a next state based on the binary state of the digital event signal relative to the triggering edge of the second clock signal;

a first pulse generation circuit having a first input terminal for receiving the event signal, a second input terminal for receiving the first digital output signal, and an output terminal for providing a first pulse signal, the first pulse signal having a rising edge corresponding to the digital event signal and a falling edge corresponding to the first digital output signal; and a second pulse generation circuit having a first input terminal for receiving the event signal, a second input terminal for receiving the second digital output signal, and an output terminal for providing a second pulse signal, the second pulse signal having a rising edge corresponding to the digital event signal and a falling edge corresponding to the second digital output signal.

10. The time stamping circuit of claim 9, wherein at least one of the first and second memory logic circuits comprises at least one of a flip-flop and a latch.

11. The time stamping circuit of claim 9, wherein at least one of the first and second memory logic circuits comprises a positive edge-triggered flip-flop.

12. The time stamping circuit of claim 9, wherein at least one of the first and second pulse generation circuits comprises a logic gate.

13. The time stamping circuit of claim 12, wherein the logic gate comprises an "XOR" gate.

14. The time stamping circuit of claim 9, wherein the second clock signal comprises the first clock signal shifted by a predetermined amount of time.

15. The time stamping circuit of claim 9, wherein the first clock signal and the second clock signal have 50% duty cycle.

16. A time stamping circuit for generating a time stamp having an improved time resolution for an event signal, the time stamping circuit comprising:

a first memory logic circuit comprising a first terminal for receiving a digital event signal, a second terminal for receiving a first clock signal, and a third terminal for providing a first digital output signal, a current state of the first digital output signal being changed to a next state based on the binary state of the digital event signal relative to the positive edge of the first clock signal;

a second memory logic circuit comprising a first terminal for receiving the digital event signal, a second terminal for receiving the first clock signal, and a third terminal for providing a second digital output signal, a current state of the second digital output signal being changed to a next state based on the binary state of the digital event signal relative to the negative edge of the first clock signal;

a third memory logic circuit comprising a first terminal for receiving the digital event signal, a second terminal for receiving a second clock signal, and a third terminal for providing a third digital output signal, a current state of the third digital output signal being changed to a next state based on the binary state of the digital event signal relative to the positive edge of the second clock signal; and a fourth memory logic circuit comprising a first terminal for receiving the digital event signal, a second terminal for receiving the second clock signal, and a third terminal for providing a fourth digital output signal, a current state of the fourth digital output signal being changed to a next state based on the binary state of the digital event signal relative to the negative edge of the second clock signal.

17. The time stamping circuit of claim 16, further comprising:

a first pulse generation circuit having a first input terminal for receiving the digital event signal, a second input terminal for receiving the first digital output signal, and an output terminal for providing a first pulse signal, the first pulse signal having a rising edge corresponding to the digital event signal and a falling edge corresponding to the first digital output signal;

a second pulse generation circuit having a first input terminal for receiving the digital event signal, a second input terminal for receiving the second digital output signal, and an output terminal for providing a second pulse signal, the second pulse signal having a rising edge corresponding to the digital event signal and a falling edge corresponding to the second digital output signal;

a third pulse generation circuit having a first input terminal for receiving the digital event signal, a second input terminal for receiving the third digital output signal, and an output terminal for providing a third pulse signal, the third pulse signal having a rising edge corresponding to the digital event signal and a falling edge corresponding to the third digital output signal; and a fourth pulse generation circuit having a first input terminal for receiving the digital event signal, a second input terminal for receiving the fourth digital output signal, and an output terminal for providing a fourth pulse signal, the fourth pulse signal having a rising edge corresponding to the digital event signal and a falling edge corresponding to the fourth digital output signal.

18. The time stamping circuit of claim 16, wherein at least one of the first, second, third, and fourth memory logic circuits comprises at least one of a flip-flop and a latch.

19. The time stamping circuit of claim 16, wherein at least one of the first, second, third, and fourth memory logic circuits comprises a positive edge-triggered flip-flop.

20. The time stamping circuit of claim 17, wherein at least one of the first, second, third, and fourth pulse circuits comprises a logic gate.

21. The time stamping circuit of claim 20, wherein the logic gate comprises an "XOR" gate.

22. The time stamping circuit of claim 16, wherein the second clock signal comprises the first clock signal shifted by a predetermined amount of time.

23. The time stamping circuit of claim 16, wherein the first clock signal and the second clock signal have 50% duty cycle.

24. The time stamping circuit of claim 16, further comprising a first logic circuit for selecting one of the first and second digital output signals.

25. The time stamping circuit of claim 24, wherein the first logic circuit comprises an "OR" gate.

26. The time stamping circuit of claim 24, further comprising a second logic circuit for selecting one of the second and third digital output signals.

27. The time stamping circuit of claim 26, further comprising:

a first pulse generation circuit having a first input terminal for receiving the digital event signal, a second input terminal connected to an output of the first logic circuit, and an output terminal for providing a first pulse signal, the first pulse signal having a rising edge corresponding to the digital event signal and a falling edge corresponding to the digital output signal selected by the first logic circuit; and a second pulse generation circuit having a first input terminal for receiving the digital event signal, a second input terminal connected to an output of the second logic circuit, and an output terminal for providing a second pulse signal, the second pulse signal having a rising edge corresponding to the digital event signal and a falling edge corresponding to the digital output signal selected by the second logic circuit.

28. The time stamping circuit of claim 27, further comprising a pulse selection circuit for determining which of the first pulse signal and the second pulse signal is to be used for generating the time stamp for the event signal.

29. The time stamping circuit of claim 28, wherein the pulse selection circuit comprises:

a fifth memory logic circuit comprising a first terminal for receiving the first clock signal, a second terminal for receiving the digital event signal, and a third terminal for providing a fifth digital output signal, a current state of the fifth digital output signal being changed to a next state based on the binary state of the digital event signal relative to the triggering edge of the first clock signal;

a sixth memory logic circuit comprising a first terminal for receiving the second clock signal, a second terminal for receiving the digital event signal, and a third terminal for providing a sixth digital output signal, a current state of the sixth digital output signal being changed to a next state based on the binary state of the digital event signal relative to the triggering edge of the second clock signal; and a decoder having input terminals for receiving the fifth and sixth digital output signals, the decoder configured to determine which of the first pulse signal and the second pulse signal are to be used for generating the time stamp for the event signal.

30. The time stamping circuit of claim 29, further comprising a delay element that receives the digital event signal and provides a delayed signal to the fifth and sixth memory logic circuits.

31. The time stamping circuit of claim 28, wherein at least one of the fifth and sixth memory logic circuits comprises at least one of a flip-flop and a latch.

32. The time stamping circuit of claim 28, wherein the pulse selection circuit is configured to capture a phase state corresponding to each of the first clock signal and second clock signal at the time of the digital event signal.

33. The time stamping circuit of claim 32, wherein the pulse selection circuit is further configured to decode the phase state for the first and second clock signals and, based on the phase state, determine which of the first pulse signal and the second pulse signal to use for generating the time stamp for the digital event signal.

* * * * *